US009805853B2

(12) United States Patent
Yamazaki et al.

(10) Patent No.: US 9,805,853 B2
(45) Date of Patent: Oct. 31, 2017

(54) ISOLATION TRANSFORMER, AND X-RAY GENERATING APPARATUS AND RADIOGRAPHY SYSTEM INCLUDING THE SAME

(71) Applicant: CANON KABUSHIKI KAISHA, Tokyo (JP)

(72) Inventors: Koji Yamazaki, Ayase (JP); Yasuhiro Hamamoto, Yokohama (JP); Shuji Aoki, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 135 days.

(21) Appl. No.: 14/969,611

(22) Filed: Dec. 15, 2015

(65) Prior Publication Data

US 2016/0196915 A1 Jul. 7, 2016

(30) Foreign Application Priority Data

Jan. 7, 2015 (JP) ..... 2015-001371

(51) Int. Cl.

| | |
|---|---|
| ***H01F 27/28*** | (2006.01) |
| ***H01F 27/12*** | (2006.01) |
| ***H01F 27/02*** | (2006.01) |
| ***H05G 1/10*** | (2006.01) |
| ***H01F 27/32*** | (2006.01) |
| ***H01F 30/16*** | (2006.01) |

(52) U.S. Cl.

CPC ..... *H01F 27/12* (2013.01); *H01F 27/025* (2013.01); *H01F 27/324* (2013.01); *H01F 30/16* (2013.01); *H05G 1/10* (2013.01)

(58) Field of Classification Search

CPC .. H01F 27/28; H01F 27/02; H01F 2924/0002; H01F 30/16; H01F 27/08; Y10T 29/4902; Y01T 29/49071; H05G 1/04; H05G 1/02; H01J 35/16; H01J 2235/1204

USPC ..... 378/130, 131; 336/58, 62, 57

See application file for complete search history.

(56) References Cited

U.S. PATENT DOCUMENTS

| | | | | |
|---|---|---|---|---|
| 5,123,038 A * | 6/1992 | Negle | ..... | H05G 1/10 378/101 |
| 2013/0148781 A1 | 6/2013 | Yamazaki et al. | | |
| 2013/0235975 A1 | 9/2013 | Tamura et al. | | |
| 2014/0140486 A1 | 5/2014 | Yanagisawa et al. | | |
| 2014/0153695 A1 | 6/2014 | Yanagisawa et al. | | |

FOREIGN PATENT DOCUMENTS

| | | |
|---|---|---|
| JP | 11-74135 A | 3/1999 |

* cited by examiner

*Primary Examiner* — Don Wong

(74) *Attorney, Agent, or Firm* — Fitzpatrick, Cella, Harper & Scinto

(57) ABSTRACT

Both the size reduction and the increase in breakdown voltage of a high-voltage isolation transformer are realized, which is to be used in an insulating liquid in an X-ray generating apparatus. In the isolation transformer, an annular core and a primary coil wound around the annular core are housed in a first container, and a secondary coil is wound around the first container. A first opening through which an insulating liquid flows is provided in the first container.

21 Claims, 9 Drawing Sheets

ISOLATION TRANSFORMER, AND X-RAY GENERATING APPARATUS AND RADIOGRAPHY SYSTEM INCLUDING THE SAME

BACKGROUND OF THE INVENTION

Field of the Invention

The present invention relates to an isolation transformer to be used under a high voltage, and an X-ray generating apparatus and a radiography system each including the isolation transformer.

Description of the Related Art

In general, an X-ray generating apparatus includes an X-ray generating tube configured to generate an X-ray by irradiating a target with an electron beam flux emitted from an electron gun, a tube voltage generating device configured to apply a high voltage between an anode and a cathode of the X-ray generating tube, and a drive device for the electron gun. Further, there has been known a mono-tank X-ray generating apparatus in which those respective members are disposed in a container. The mono-tank X-ray generating apparatus may be applied to a portable X-ray generating apparatus and is advantageous in size reduction.

Meanwhile, the drive device for the electron gun includes an isolation transformer configured to transform a voltage of a drive signal from a power source located outside of the X-ray generating apparatus into a cathode potential reference. A primary side of the isolation transformer is close to a ground potential and a secondary side thereof substantially has a cathode potential. Thus, the isolation transformer is required to have a high breakdown voltage.

In order to reduce the X-ray generating apparatus in size, the isolation transformer is required to be reduced in size. As one solution for this, there is an isolation transformer using a toroidal core. In Japanese Patent Application Laid-Open No. H11-74135, as a technology for providing a high-voltage isolation transformer using a toroidal core, there is disclosed a structure in which a core is covered by a resin case and coils are wound around the core and the resin case, thereby increasing breakdown voltages of the core and the resin case.

An insulating liquid is generally filled into the X-ray generating apparatus in order to ensure an internal breakdown voltage and cool the X-ray generating tube. The X-ray generating apparatus is filled with an insulating liquid as follows: the X-ray generating tube and other necessary devices are housed in a container, and the container is then evacuated. When the isolation transformer of Japanese Patent Application Laid-Open No. H11-74135 is applied to such an X-ray generating apparatus, gas bubbles may be trapped in the resin case due to an insulating liquid permeating into the resin case during the insulating liquid filling. In general, as the insulating liquid, a mineral oil that has a higher dielectric constant than gas bubbles (air) is used. Thus, if gas bubbles are trapped in the resin case of the isolation transformer, an electric field tends to be concentrated on the gas bubbles, resulting in a reduction in breakdown voltages of portions in which the gas bubbles remain. As a result, reliability of the apparatus is reduced in terms of driving of the electron gun.

SUMMARY OF THE INVENTION

The present invention is directed to realizing both size reduction and increase in breakdown voltage of a high-voltage isolation transformer to be used in an insulating liquid in an X-ray generating apparatus, and to providing a highly-reliable X-ray generating apparatus and a radiography system using the apparatus.

According to a first aspect of the present invention, there is provided an isolation transformer, including: an annular core; one coil wound around the annular core; a first container housing the annular core and the one coil, the first container having an annular shape and an insulating property; a first lead-out line pair that is connected to the one coil and is extracted outside the first container; another coil wound around the first container; and a second lead-out line pair connected to the other coil, the isolation transformer being disposed in an insulating liquid, the first container having formed therein a first opening through which the insulating liquid flows.

According to a second aspect of the present invention, there is provided an X-ray generating apparatus, including: an X-ray generating tube housed in a container; and a drive device configured to drive the X-ray generating tube, in which a surplus space in the container is filled with an insulating liquid, and in which the drive device includes the isolation transformer of the first aspect of the present invention in the container.

According to a third aspect of the present invention, there is provided a radiography system, including: an X-ray generating apparatus; an X-ray detecting apparatus configured to detect an X-ray emitted from the X-ray generating tube and transmitted through an object to be examined (hereinafter simply referred to as "object"); and a control apparatus configured to control the X-ray generating apparatus and the X-ray detecting apparatus in a coordinated manner.

Further features of the present invention will become apparent from the following description of exemplary embodiments with reference to the attached drawings.

BRIEF DESCRIPTION OF THE DRAWINGS

FIG. 1A is a perspective view, FIG. 1B is a top view, FIG. 1C is a side view of one coil lead-out line pair side, and FIG. 1D is a side view of another coil lead-out line pair side.

FIG. 3A is a top view in a state in which one side of the first container is removed, and FIG. 3B is a sectional view taken along the line A-A' of FIG. 1B.

FIG. 4A is an illustration of a mode in which two members are not fitted to each other, and FIG. 4B is an illustration of a mode in which two members are fitted to each other.

FIG. 5A is a top view, FIG. 5B is a side view of the partition structure, FIG. 5C is a side view of the one coil lead-out line pair side, FIG. 5D is a side view of the other coil lead-out line pair side, and FIG. 5E is a sectional view taken along the line A-A' of FIG. 5A.

FIG. 6A is a perspective view, FIG. 6B is a side view of the one coil lead-out line pair side, and FIG. 6C is a side view of the other coil lead-out line pair side.

DESCRIPTION OF THE EMBODIMENTS

Figure 1A:
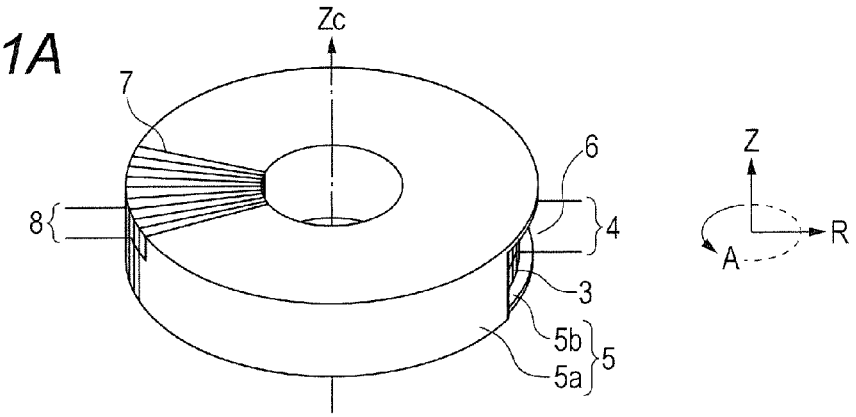
FIGS. 1A, 1B, 1C, and 1D are views for schematically illustrating a configuration of an isolation transformer according to an embodiment of the present invention.

Now, exemplary embodiments of the present invention are described in detail with reference to the attached drawings, but the present invention is not limited to these embodiments. In addition, a known or well-known technology in the art is applied to a part that is not particularly illustrated or described in this specification. Further, in the drawings to be referred to below, the same numeral or symbol denotes the same component.

[Isolation Transformer]

Figure 1B:
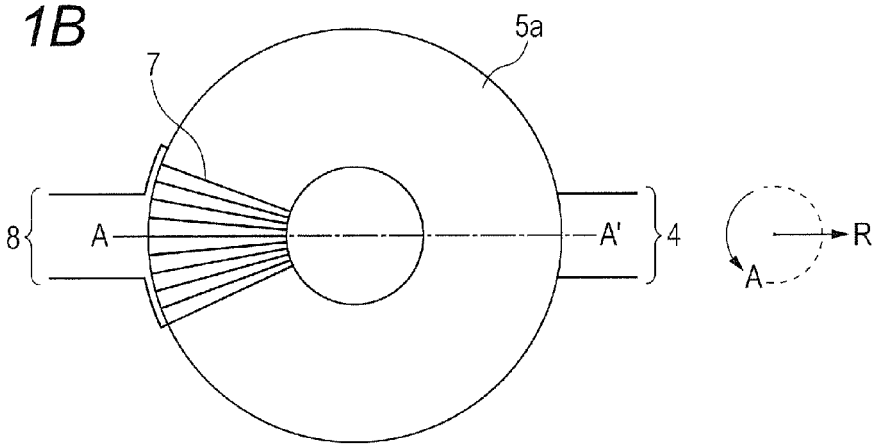
Figure 1C:
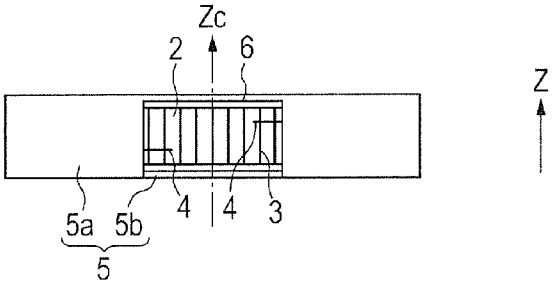
Figure 1D:
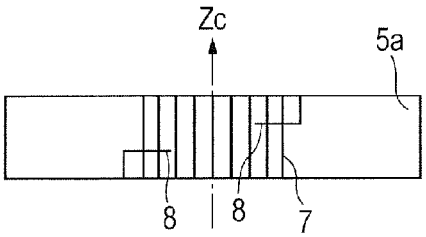
Figure 2:
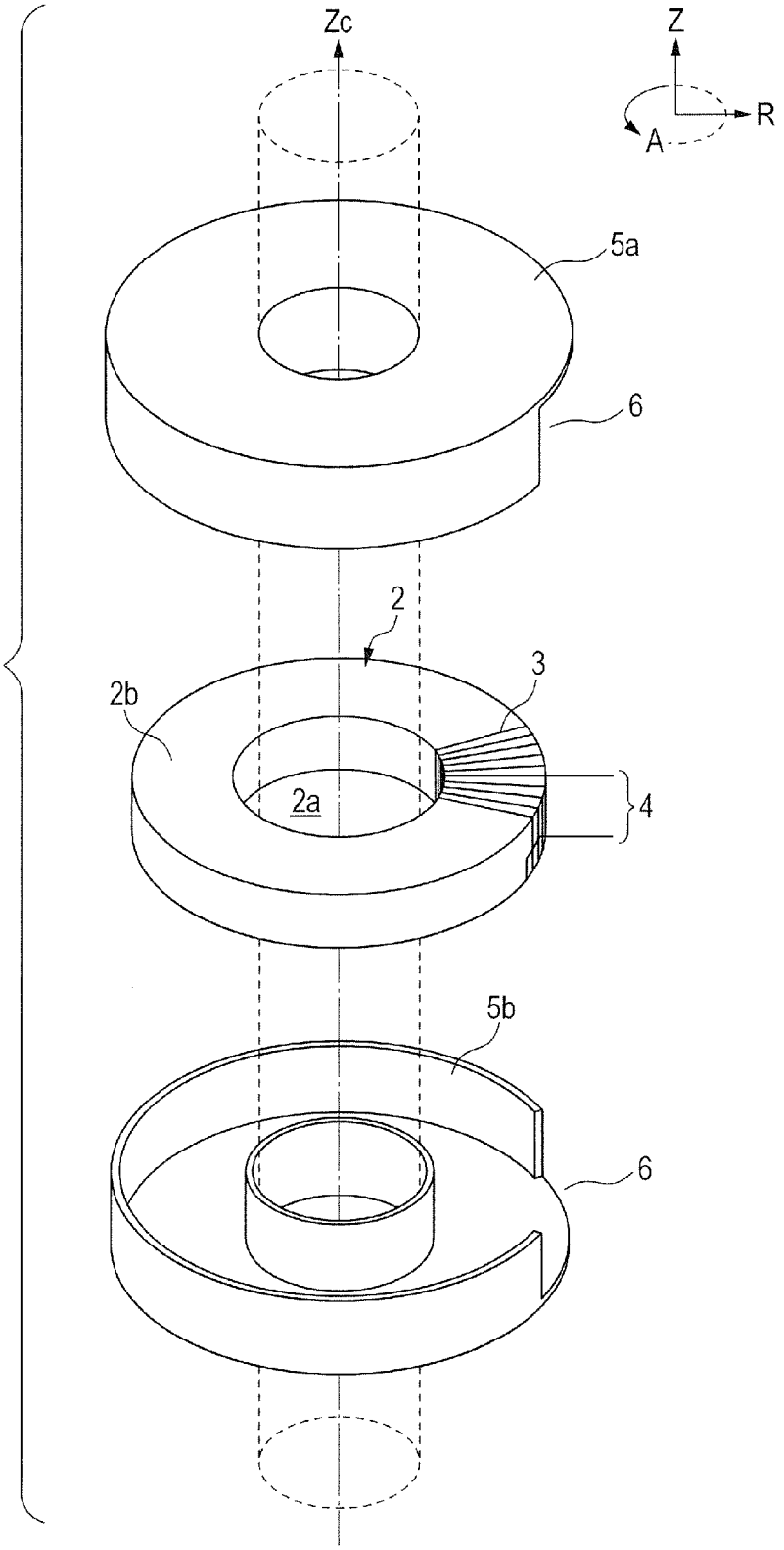
FIG. 2 is a perspective view for illustrating a state in which a first container of the isolation transformer of FIGS. 1A to 1D is exploded.

FIG. 1A to FIG. 1D are views for schematically illustrating a configuration of an isolation transformer according to an embodiment of the present invention. FIG. 1A is a perspective view, FIG. 1B is a top view, and FIG. 1C and FIG. 1D are side views. FIG. 1C is a right side view and FIG. 1D is a left side view. FIG. 2 is an exploded perspective view of the isolation transformer of FIG. 1A to FIG. 1D.

The isolation transformer of the present invention is supposed to be used in an X-ray generating apparatus, and employs an annular core (toroidal core, hereinafter referred to as "core") 2 in terms of a size reduction and a conversion efficiency. As shown in FIG. 2, a core 2 has an annular portion 2*b* surrounding a boa portion 2*a* pierced by an imaginary axis Z. Each of an axis Z, an annular direction A and a radial direction R is shown in FIG. 2, respectively. Ferrite suitable for high-frequency use is preferably used as a material of the core 2. One coil 3 is wound around the core 2 and is electrically connected to a first lead-out line pair 4.

A first container 5 is an insulating container having an annular hollow part, and the core 2 is housed in the annular hollow part of the first container 5 together with the one coil 3 so that the inner periphery of the first container 5 and the inner periphery of the core 2 overlie each other. Another coil 7 is wound around the first container 5 and is electrically connected to a second lead-out line pair 8. In the present invention, one of the one coil 3 and the other coil 7 is a primary coil and the other thereof is a secondary coil, and any of the coils may be the primary coil. Note that, in the isolation transformer of the present invention, the primary coil on the input side has a low potential and the secondary coil on the output side has a negative high potential when the isolation transformer is used in the X-ray generating apparatus. Thus, it is preferred that the one coil 3 closer to the core 2 be used as the primary coil closer to a ground potential. Accordingly, the following description is made with the one coil 3 being the primary coil and the other coil 7 being the secondary coil.

Enameled wires are generally used as the primary coil 3 and the secondary coil 7. When the primary coil 3 has a low potential and the secondary coil 7 has a negative high potential, the core 2 has a potential close to that of the primary coil 3, which is wound therearound more closely to the core 2 than the secondary coil 7. Thus, the first container 5 is required to isolate the core 2 and the secondary coil 7 from each other at a high voltage. As an insulating material forming the first container 5, ceramics and resin are exemplified. Resin is especially preferred in terms of weight, processability, and costs, and polyether ether ketone (PEEK), acrylonitrile-butadiene-styrene (ABS), polybutylene terephthalate (PBT), an epoxy resin, a fluorine-based resin, or the like can be used.

Figure 4A:
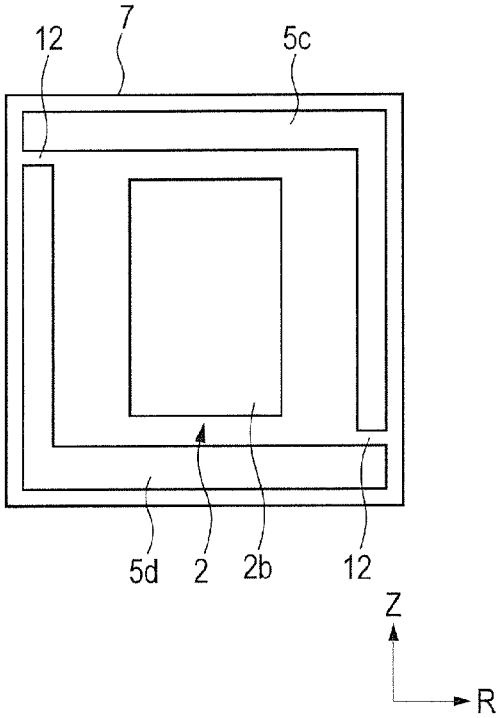
FIGS. 4A and 4B are partial schematic sectional views for illustrating a configuration of the first container of the present invention in a radial direction thereof.
Figure 4B:
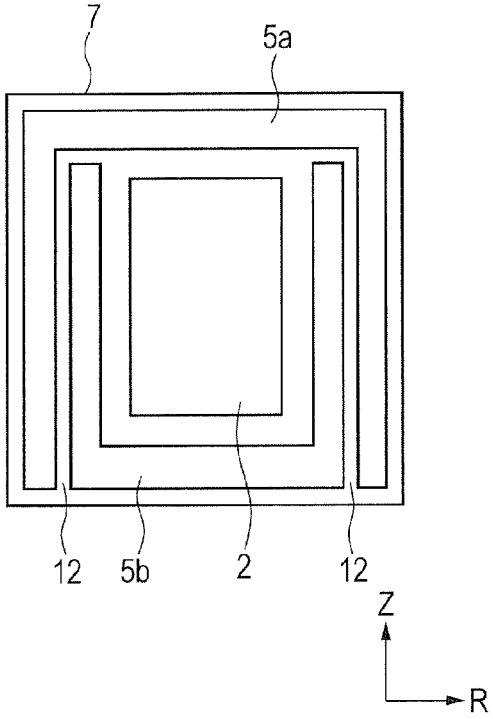

Further, in order to house the annular core 2, the first container 5 is formed of two combined members 5*a* and 5*b*. At this time, a clearance between the members 5*a* and 5*b* is weak in dielectric strength, and hence the members 5*a* and 5*b* are combined by fitting in an axial direction of the core 2, thereby increasing the breakdown voltage. This action is described with reference to FIG. 4A and FIG. 4B. FIG. 4A is a partial schematic sectional view of the first container 5 in a radial direction thereof, in which the first container 5 is formed of members 5*c* and 5*d* not fitted to each other, and FIG. 4B is a partial schematic sectional view of the first container 5 of this embodiment in a radial direction thereof. In FIG. 4A and FIG. 4B, clearances 12 formed between the two members 5*c* and 5*d* and the two members 5*a* and 5*b* are exaggerated. As illustrated in FIG. 4A, when the members 5*c* and 5*d* are not fitted to each other, the clearance 12 connecting between the annular hollow part of the first container 5 and outside of the first container 5 is a straight line and has a short length, and hence discharge easily occurs. On the other hand, as illustrated in FIG. 4B, when the members 5*a* and 5*b* are fitted to each other, the clearance 12 connecting the annular hollow part of the first container 5 and the outside of the first container 5 is not a straight line and has a long length, and hence discharge hardly occurs. Consequently, the present invention has the structure in which the two members 5*a* and 5*b* of the first container 5 are combined by fitting in the axial direction so that the two members 5*a* and 5*b* overlie each other in the radial direction, thereby increasing a dielectric strength between the core 2 and the secondary coil 7. Note that, it is preferred that a region in which the two members 5*a* and 5*b* are overlie each other in the radial direction correspond at least to regions of the two members in which the high-potential secondary coil 7 is wound in a circumferential direction of the first container 5. The region may correspond to the entire circumference except for a first opening 6 described later.

A characteristic feature of the present invention is to provide the first opening 6 through which an insulating liquid flows into the first container 5. In this embodiment, the first opening 6 is used also as a region for leading out the first lead-out line pair 4. Thus, the first opening 6 is required to have a gap for allowing an insulating liquid to flow therethrough under a state in which the first lead-out line pair 4 is extracted. In the present invention, the opening is positively provided in the first container 5, and hence an insulating liquid is successfully filled without gas bubbles trapped in the first container 5 in a process of assembling the X-ray generating apparatus. Further, in the present invention, it is desired that a region in the first container 5 other than the core 2 and the primary coil 3 be the clearance, and the first container 5 have an inner-side separated portion separated from at least one of the core 2 or the primary coil 3. It is desired that the inner-side separated portion be an annular portion along an inner wall of the first container 5. Such an inner-side separated portion serves as a path for allowing an insulating liquid to flow therethrough, with the result that the insulating liquid can be filled without gas bubbles trapped in the first container 5.

Figure 3A:
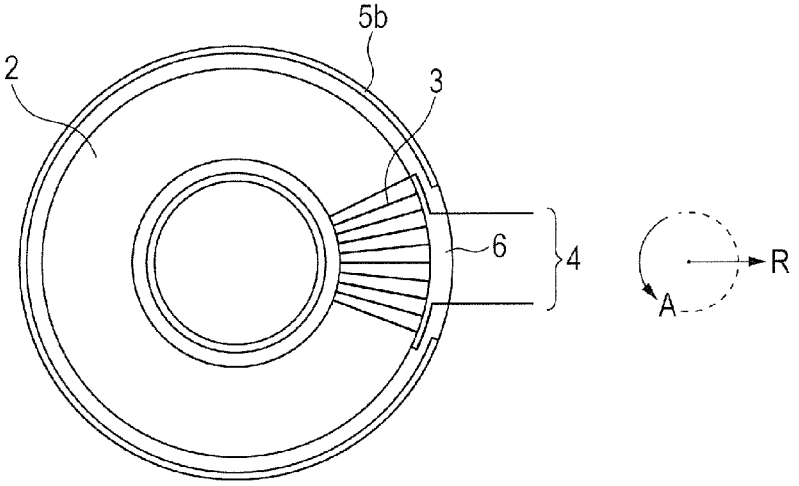
FIGS. 3A and 3B are views for illustrating the isolation transformer of FIGS. 1A to 1D.
Figure 3B:
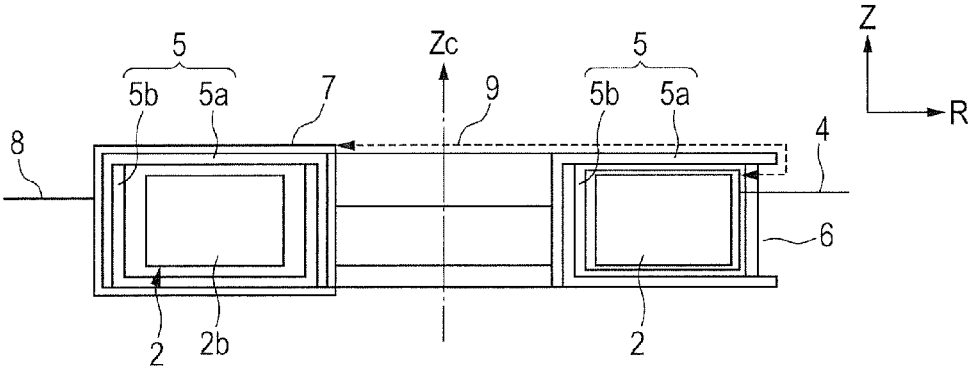
Figure 5A:
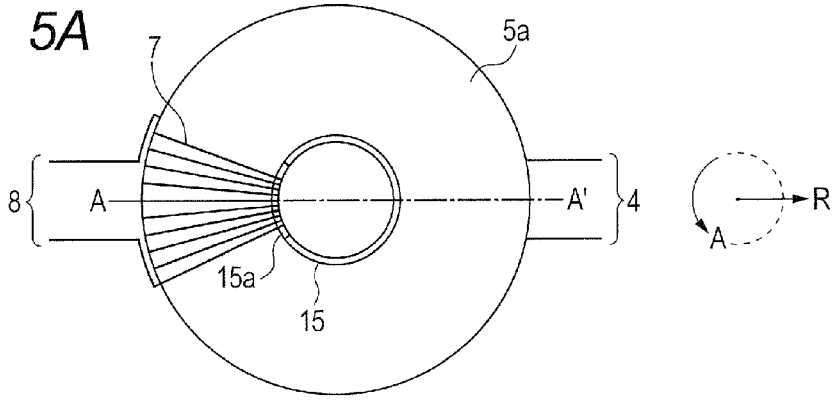
FIGS. 5A, 5B, 5C, 5D, and 5E are views for schematically illustrating a mode in which a partition structure is added to the isolation transformer of FIGS. 1A to 1D.
Figure 5C:
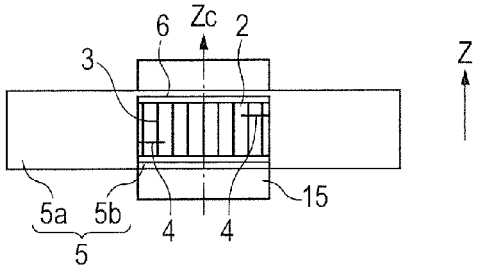
Figure 5B:
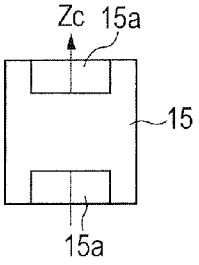
Figure 5D:
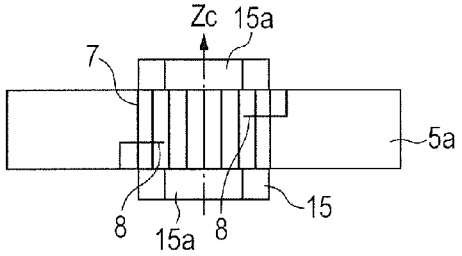
Figure 5E:
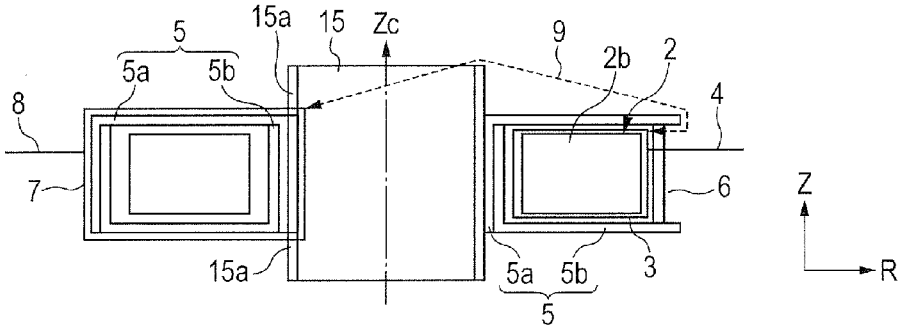

In the present invention, it is preferred that the primary coil 3 and the secondary coil 7 be symmetrically located around the central axis of the core 2. In addition, it is preferred that the first opening 6 be located in the first container 5 on an outer peripheral side thereof in terms of a breakdown voltage. When the first opening 6 is located at the outer periphery of the first container 5 as described above, as indicated by the dashed double-headed arrow 9 in FIG. 3B, the first container 5 exists between the primary coil 3 and the secondary coil 7 as a discharge barrier so that the shortest distance between the primary coil 3 and the secondary coil 7 is lengthened. Consequently, a breakdown voltage of the first container 5 on the outer side is increased. Such a discharge barrier may be positively provided as a partition structure, or as illustrated in FIGS. 5A to 5E, a tubular partition structure 15 may be fixed to the inner periphery of the first container 5. Cutout portions 15*a* are formed in the partition structure 15 in a region in which the secondary coil 7 is wound as illustrated in FIG. 5A, FIG. 5B, and FIG. 5D, and the partition structure 15 is projected in the axial direction when being fixed to the inner periphery of the first container 5 as illustrated in FIG. 5C and FIG. 5D. Consequently, as illustrated in FIG. 5E, the shortest distance 9 between the primary coil 3 and the secondary coil 7 can be further lengthened. The partition structure 15 is formed of an insulating material, which is preferably the same material as the first container 5. Further, the partition structure 15 may be formed integrally with the first container 5 in advance. Note that, in the radial direction of the first container 5, the primary coil 3 is located on one side and the secondary coil 7 is located on another side across the partition structure 15, thereby obtaining the above-mentioned action.

Figure 6A:
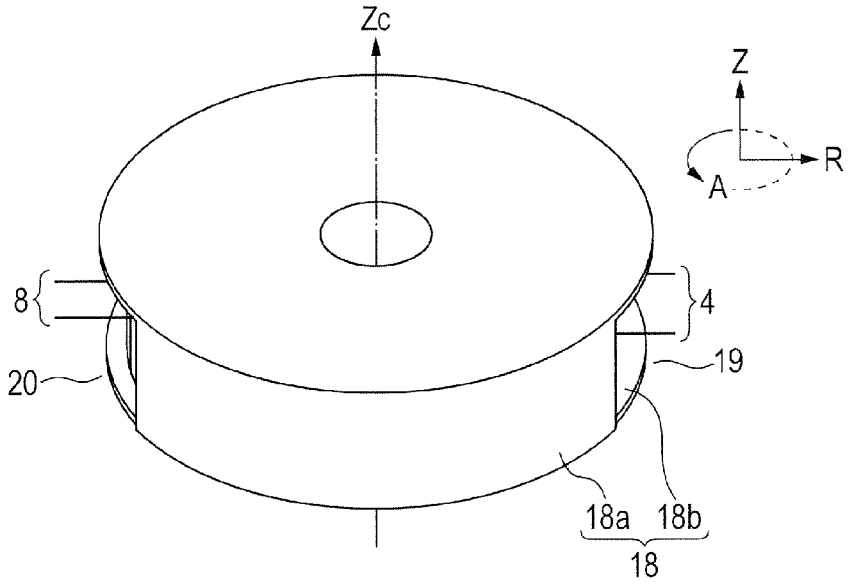
FIGS. 6A, 6B, and 6C are views for schematically illustrating a state in which the isolation transformer of FIGS. 1A to 1D is housed in a second container.
Figure 6B:
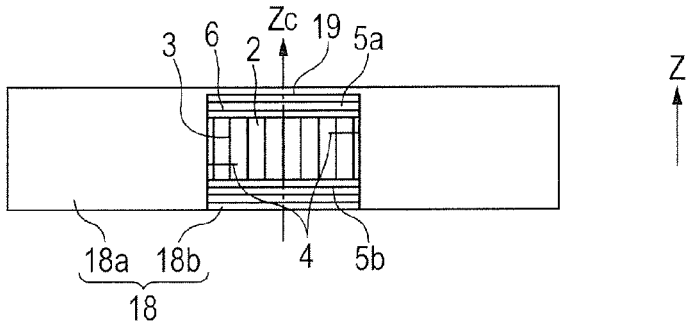
Figure 6C:
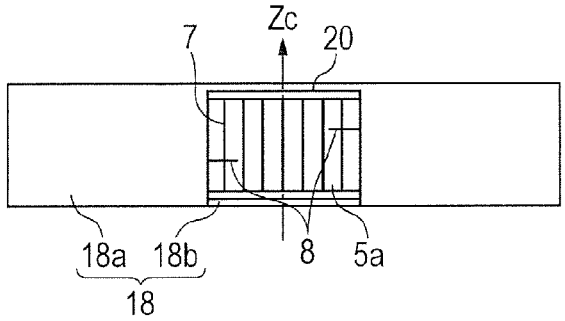
Figure 7:
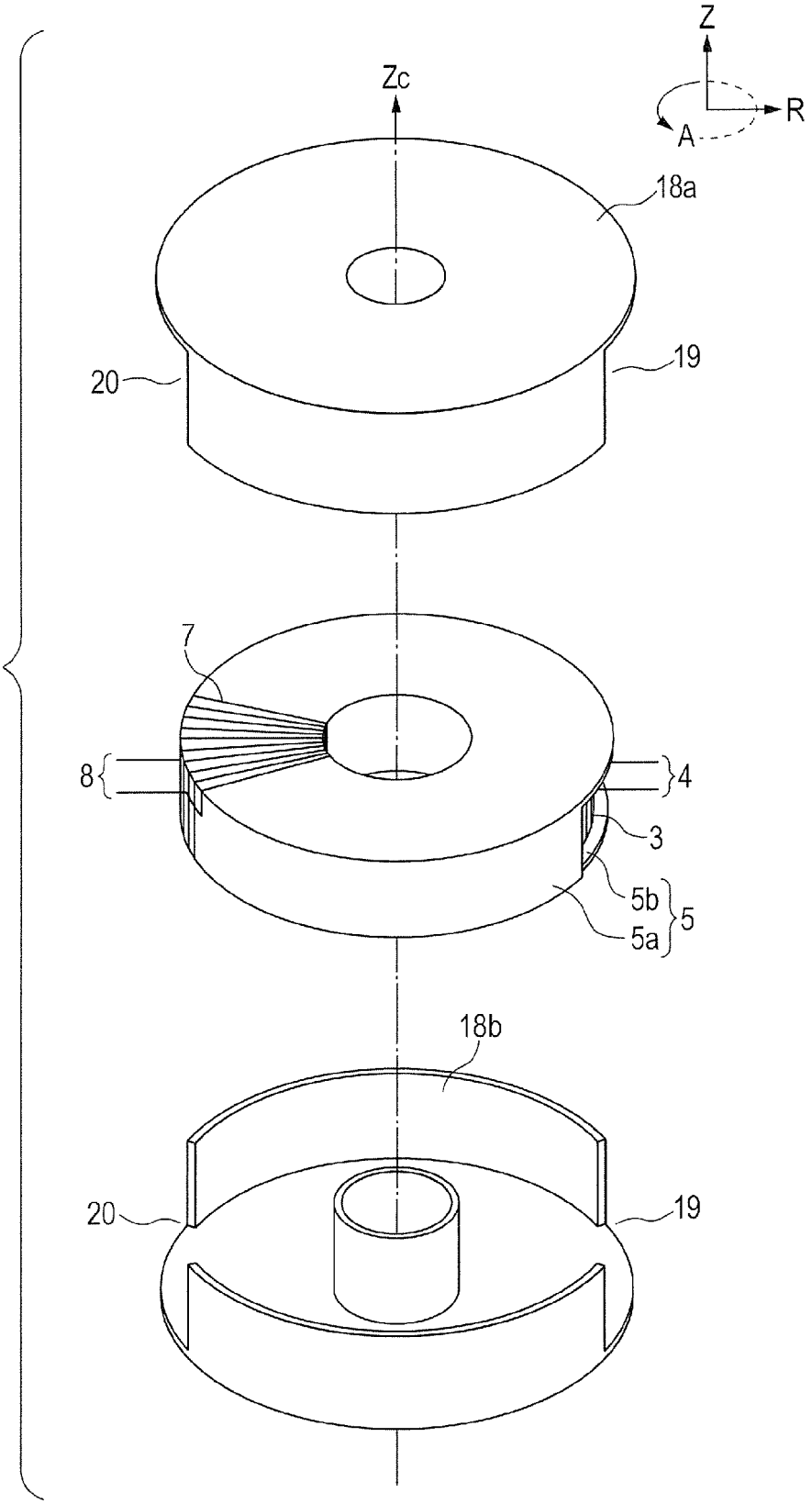
FIG. 7 is a perspective view for illustrating a state in which the second container of the isolation transformer of FIG. 6 is exploded.

In addition, in the present invention, the first container 5 and the secondary coil 7 may be housed in a second container 18 as illustrated in FIG. 6A to FIG. 7. The second container 18 has at least a second opening 19 and desirably further has a third opening 20. The first lead-out line pair 4 is extracted from the second opening 19 and the second lead-out line pair 8 is extracted from the third opening 20. Note that, the second opening 19 and the third opening 20 each have a gap for allowing an insulating liquid to flow therethrough in a state in which the first lead-out line pair 4 and the second lead-out line pair 8 are extracted.

In this embodiment, similarly to the first container 5, the second container 18 is formed of two members 18*a* and 18*b* that are fitted to each other in the axial direction, and the members 18*a* and 18*b* overlie each other over the entire circumference in the radial direction except for the second opening 19 and the third opening 20. Further, the second opening 19 and the third opening 20 are axisymmetrically formed in the outer periphery of the second container.

Also in the second container 18, it is desired that a region other than the container 5 and the secondary coil 7 be the clearance, and the second container 18 have an outer-side separated portion separated from at least one of the first container 5 or the secondary coil 7. It is desired that the outer-side separated portion be an annular portion along an inner wall of the second container 18. Such an outer-side separated portion serves as a path for allowing an insulating liquid to flow therethrough, with the result that the insulating liquid can be filled without gas bubbles trapped in the second container 18.

The second container 18 exists, as a discharge barrier, between the primary coil 3 and the secondary coil 7 and between the secondary coil 7 and other members of the X-ray generating apparatus, and contributes for increasing an internal breakdown voltage of the X-ray generating apparatus. Similarly to the first container 5, the second container 18 is formed of the two members 18*a* and 18*b* fitted to each other and has an annular hollow part. The inner periphery of the second container 18 and the inner periphery of the first container 5 are overlie each other. It is preferred that the second container 18 and the first container 5 be located concentrically.

Further, in the present invention, the first lead-out line pair 4 and the second lead-out line pair 8 are symmetrically located around the central axis of the core 2, and hence the shortest path between the first lead-out line pair 4 and the second lead-out line pair 8 is lengthened on the outer side of the first container 5 into which an insulating liquid is filled, which is preferred.

[X-ray Generating Apparatus]

Figure 8:
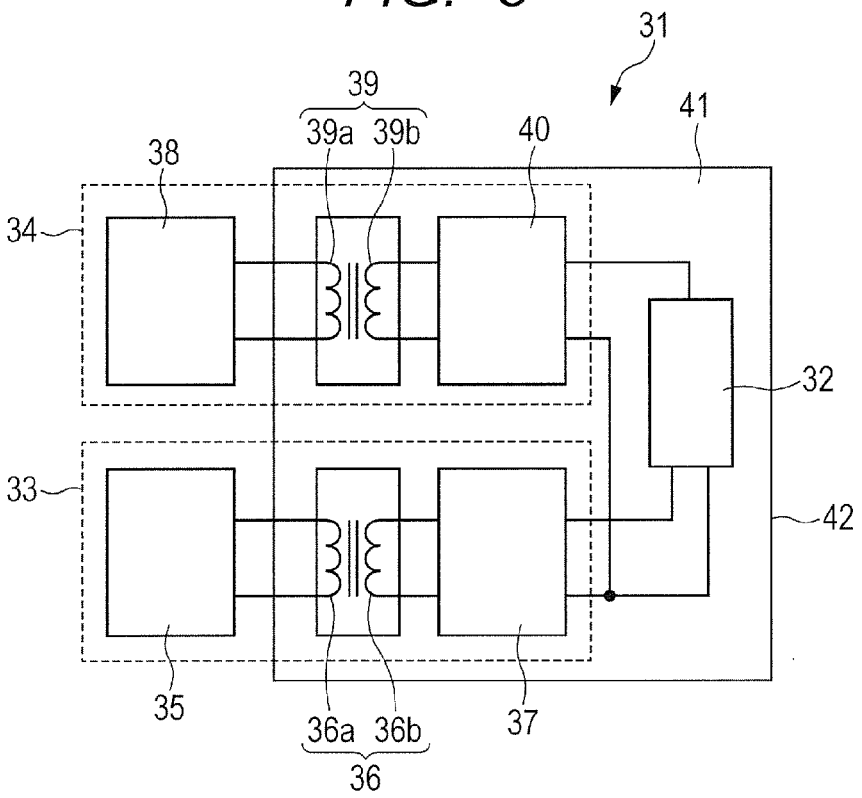
FIG. 8 is a block diagram for schematically illustrating a configuration of an X-ray generating apparatus of the present invention.

FIG. 8 is a block diagram for schematically illustrating a configuration of an X-ray generating apparatus according to an embodiment of the present invention. An X-ray generating apparatus 31 of this embodiment includes an X-ray generating tube 32, a drive device 33, and a tube voltage generating device 34. The drive device 33 includes a drive control portion 35, an isolation transformer 36, and a drive circuit 37. The tube voltage generating device includes a tube voltage control portion 38, a high-voltage transformer 39, and a high-voltage generating circuit 40. A surplus space in a container 42 is filled with an insulating liquid 41. The X-ray generating tube 32, the isolation transformer 36 and the drive circuit 37 that are a part of the drive device 33, and the high-voltage transformer 39 and the high-voltage generating circuit 40 that are a part of the tube voltage generating device 34 are soaked in the insulating liquid 41 in the container 42.

Inside of the X-ray generating tube 32, which is kept in a vacuum state, an electron gun is provided on a cathode side and a target is provided on an anode side. Electrons emitted from the electron gun are accelerated by a voltage of about from several dozen kilovolts to several hundred kilovolts applied between the electrodes and collide with the target, with the result that X-rays are emitted to the outside.

The drive device 33 is used to define potentials of, for example, a filament, a grid electrode, and a lens electrode (all not shown), which are required for driving the electron gun. In the drive device 33, the isolation transformer 36 multiplies, by an AC signal of about 10 V or a pulse train signal from the drive control portion 35, a cathode potential of the X-ray generating tube 32 generated by the high-voltage generating circuit 40 described later, and the drive circuit 37 generates and outputs a potential defining signal. The isolation transformer 36 includes a primary coil 36*a* electrically connected to an AC power source in the drive control portion 35, and a secondary coil 36*b* electrically connected to the drive circuit 37 having the cathode potential as a reference. The isolation transformer 36 transforms a voltage of a signal (AC voltage) from the drive control portion 35 into hundreds of volts at the maximum with a suitable turns ratio, and outputs the resultant to the drive circuit 37. The isolation transformer 36 is required to have a dielectric strength between the primary coil 36*a* close to the ground potential and the secondary coil 36*b* having the cathode potential, the secondary coil 36*b* being connected on a low potential side of the high-voltage generating circuit 40. Thus, the isolation transformer 36 is a high-voltage isolation transformer in which the primary coil 36*a* and the secondary coil 36*b* are isolated from each other by the permeation of the insulating liquid 41. Further, a plurality of the isolation transformers 36 may be used, and in this case, the isolation transformers 36 may be selectively used depending on outputs to be generated. The drive circuit 37 is a circuit including a full-wave rectifier circuit, a half-wave rectifier circuit, a Cockcroft-Walton circuit, and the like, and can be appropriately used depending on each of potentials of the potential defined portions. For example, the cathode potential is multiplied by signals so that the lens electrode is applied with a DC voltage of about 1 kV, the grid electrode is applied with a pulsed voltage of about 100 V, and the filament is applied with a DC voltage of about 10 V.

In the tube voltage generating device 34, an AC signal having a voltage of about from dozens of volts to hundreds of volts is input from the tube voltage control portion 38 to the primary coil 39*a* of the high-voltage transformer 39, and the signal is boosted by the secondary coil 39*b* having a turns ratio of about from 20 to 500. Then, the high-voltage generating circuit 40 generates a DC voltage of about from twice to 12 times as large as the original voltage. The high-voltage transformer 39 is a high-voltage isolation transformer in which the primary coil 39*a* and the secondary coil 39*b* having a high voltage are isolated from each other by the permeation of the insulating liquid 41. The high-voltage generating circuit 40 is a voltage doubler rectifier circuit as represented by a Cockcroft-Walton circuit. In general, the anode of the X-ray generating tube 32 is grounded and the cathode thereof is applied with a negative tube voltage. Alternatively, a tube voltage is divided into a positive voltage and a negative voltage to be applied to the anode and the cathode, respectively. As a result, a potential of the cathode during driving is always a negative high voltage.

The insulating liquid 41 ensures a dielectric strength in the container 42. As the insulating liquid 41, an electrical insulating oil such as a mineral oil, a silicone oil, or a fluorine-based oil is preferred. For an X-ray generating apparatus having a tube voltage of about 100 kV, a mineral oil that is easily handled is preferably applied.

The container 42 is made of a metal such as iron, stainless steel, lead, brass, or copper. In order to handle the X-ray generating apparatus 31 safely, it is preferred that a potential of the container 42 be defined to the ground potential.

A method of filling the insulating liquid 41 involves: housing all of necessary members in the container 42; thereafter placing the container 42 in a vacuum chamber for vacuuming, in a state in which an insulating liquid inlet of the container is opened; filling an insulating liquid into the container 42 through the inlet in a vacuum atmosphere; and then, releasing the vacuum atmosphere and sealing the inlet.

[Radiography System]

Figure 9:
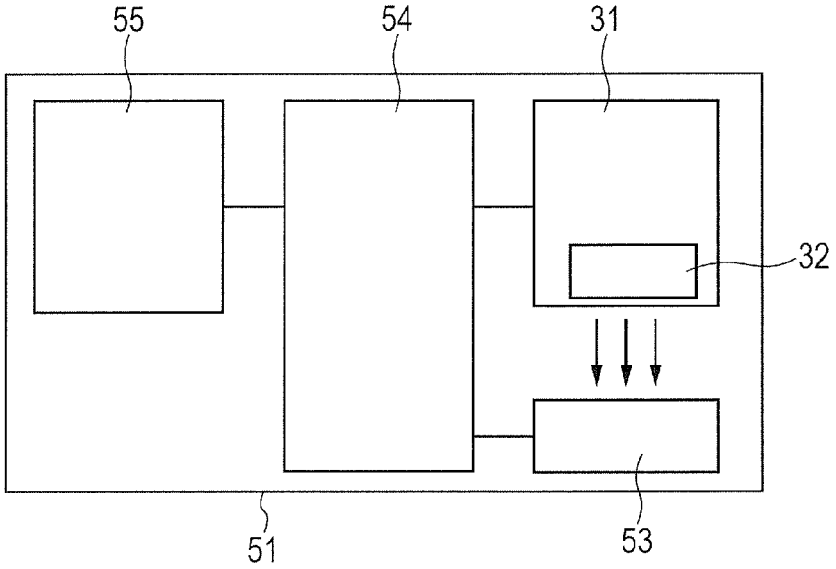
FIG. 9 is a block diagram for schematically illustrating a configuration of a radiography system of the present invention.

FIG. 9 is a schematic diagram for illustrating a configuration of a radiography system 51 according to the embodiment of the present invention. In this embodiment, a control apparatus 54 controls the X-ray generating apparatus 31 of the present invention and an X-ray detecting apparatus 53 in a coordinated manner. A tube voltage circuit (not shown), which is included in the X-ray generating apparatus 31, outputs various control signals to the X-ray generating tube 32 under the control of the control apparatus 54. With the control signals, emitting states of X-rays to be emitted from the X-ray generating apparatus 31 are controlled. An X-ray emitted from the X-ray generating apparatus 31 is transmitted through an object (not shown) and then detected by the X-ray detecting apparatus 53. The X-ray detecting apparatus 53 converts the detected X-ray into an image signal and outputs the image signal to the control apparatus 54. The control apparatus 54 outputs a display signal to a display device 55 based on the image signal, the display signal causing the display device 55 to display an image. The display device 55 displays an image based on the display signal on a screen as a taken image of the object.

The radiography system 51 of the present invention includes the X-ray generating apparatus 31 employing a small and high-voltage isolation transformer, and hence a smaller system that is stable in breakdown voltage is provided.

EXAMPLES

Example 1 and Comparative Example 1

An isolation transformer having the structure illustrated in FIG. 1A to FIG. 3B was manufactured. A ferrite toroidal core having an outer diameter of 30 mm, an inner diameter of 20 mm, and a height of 15 mm was used as the core 2. The core 2 has a cross-sectional shape that is not a perfect rectangle but has rounded corners. Polyurethane-coated enameled copper wires were used for the primary coil and the secondary coil 7. An outer diameter of the enameled copper wire for the primary coil 3 was 0.4 mm, and an outer diameter of the enameled copper wire for the secondary coil 7 was 0.16 mm. The enameled copper wires were continuously extracted from the coils so that the extracted portions served as the first lead-out line pair 4 and the second lead-out line pair 8.

The first container 5 was formed of a PEEK resin through cutting work. The first container 5 has an axisymmetric doughnut-shape. The members 5*a* and 5*b* forming the first container 5 were formed so that the members each had a thickness of 1 mm at a fitting portion and a thickness of 2 mm at portions other than the fitting portion, an annular hollow part formed of the first container 5 surrounded a cross-section of 5 mm×15 mm of the core 2, and a cross-section of the hollow part was 6 mm×16 mm. Further, as illustrated in FIG. 1A to FIG. 3B, outer peripheral walls of the members 5*a* and 5*b* forming the first container 5 are each cutout by a width of 5 mm and a height of 16 mm in the circumferential direction. The members 5*a* and 5*b* were combined so that the cutouts of 5 mm×16 mm were matched to each other, to thereby form the first opening 6.

The primary coil 3 was wound around the core 2 20 times, and both ends of the primary coil 3 were connected to the first lead-out line pair 4. The core 2 around which the primary coil 3 was wound was housed in the first container 5, and the first lead-out line pair 4 was extracted from the first opening 6. The inner-side separated portion 9 was formed between the core 2 around which the primary coil 3 was wound and the annular hollow part of the first container 5. In the first opening 6, the core 2 is retracted from the first container 5, and an end portion of the core 2 is retracted from an end portion of the member 5*a* by 2 mm and from an end portion of the member 5*b* by 1 mm. The first opening 6 was formed so that the center thereof in the circumferential direction was positioned at the center of the region in which the primary coil 3 was wound.

Then, the secondary coil 7 was wound around the core 2 200 times in an overlaid manner so as to have a width of about 5 mm, on a side opposed to the first opening 6 across the central axis of the first container 5, and both ends of the secondary coil 7 were connected to the second lead-out line pair 8, to thereby obtain an isolation transformer according to Example 1 of the present invention.

The above-mentioned isolation transformer was housed in a container, and the container was placed in a vacuum chamber under a state in which an insulating liquid inlet of the container was opened. Then, an insulating liquid was filled into the container under a vacuum state, and a breakdown voltage was evaluated by soaking the isolation transformer in the insulating liquid. A high-voltage insulating oil A (trade name; manufactured by JX Nippon Oil & Energy Corporation) was used as the insulating liquid. The first lead-out line pair 4 was grounded and the second lead-out line pair 8 was connected to an output of a commercially available high-voltage power source. Then, a high voltage was applied between the primary coil 3 and the secondary coil 7. The voltage was increased by 1 kV per second and discharge voltages were examined. As Comparative Example 1, an isolation transformer without the first opening 6 was also measured. The phrase "without the first opening 6" means that there is only a hole through which the first lead-out line pair 4 barely passes, and the remaining configuration of Comparative Example 1 is the same as that of Example 1. The average of the discharge voltages was about 80 kV in Comparative Example 1 and about 110 kV in Example 1. From the foregoing, it was confirmed that the isolation transformer of the present invention was increased in breakdown voltage for use in the insulating liquid.

Example 2

An isolation transformer was manufactured similarly to Example 1 with the exception that, as illustrated in FIG. 5A to FIG. 5E, the separately manufactured partition structure 15 was fixed to the inner periphery of the first container 5. The partition structure 15 had a cylindrical shape having an outer diameter of 15 mm, a thickness of 1 mm, and a length of 40 mm. The cutout 15*a* each having a length of 10 mm and a width of 5 mm were formed in both ends of the partition structure 15 so that the secondary coil 7 was to be wound therearound. The partition structure 15 was formed of a PEEK resin through cutting work. Further, the partition structure 15 was not fixed to the first container 5 with an adhesive or the like, but was fixed thereto by being wound by the secondary coil 7 together with the first container 5 after the partition structure 15 and the first container 5 were aligned. The shortest distance between the primary coil 3 and the secondary coil 7 is lengthened by about 7 mm with the use of the partition structure 15, compared to the case without the partition structure 15.

The above-mentioned isolation transformer was used, and a breakdown voltage was evaluated in the insulating liquid similarly to Example 1. As a result, the average of discharge voltages of this example 1 was about 125 kV. This is because discharge between the primary coil 3 and the secondary coil 7 less occurred outside of the isolation transformer, and hence the discharge voltages were increased from Example 1. From the foregoing, an effect of the partition structure 15 was confirmed, and it was confirmed that the isolation transformer was more increased in breakdown voltage.

Example 3

Figure 10:
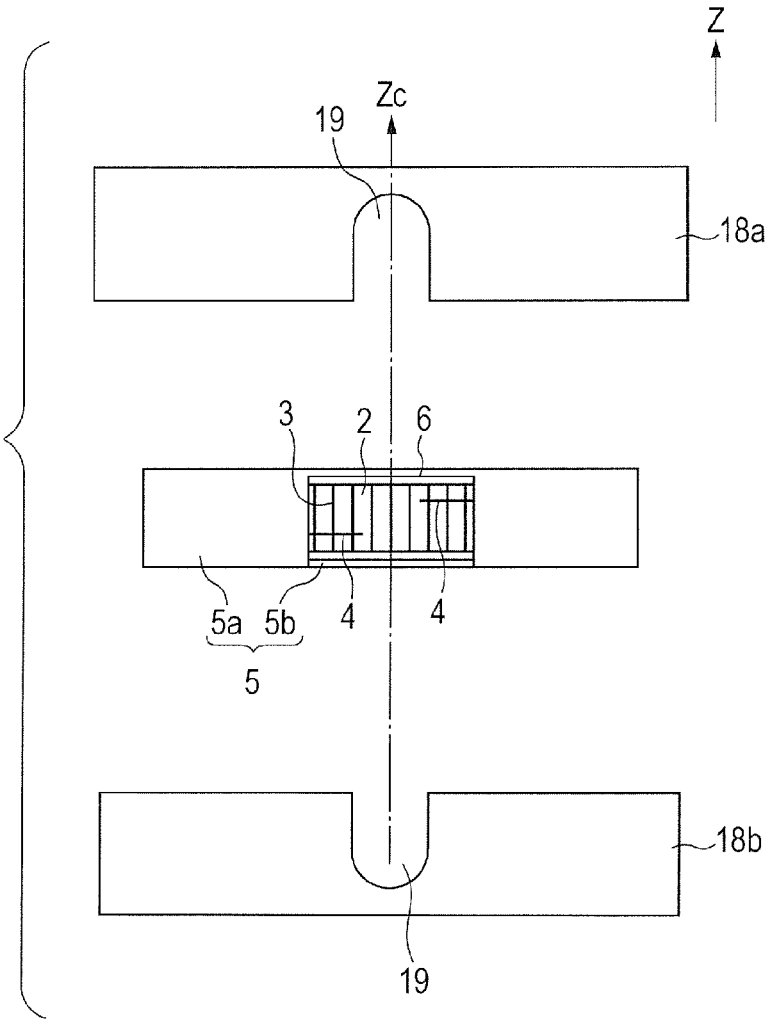
FIG. 10 is a side view for illustrating a second opening of the second container used in Example 3 of the present invention.

An isolation transformer was manufactured similarly to Example 1 except for using the second container 18 illustrated in FIG. 6A to FIG. 7. The second container 18 that was formed of a PEEK resin through cutting work and had an axisymmetric doughnut-shape similarly to the first container 5 was disposed concentrically with the first container 5. A cross-section of a portion of the first container 5 around which the secondary coil 7 is wound has an entire circumference larger than those of other portions thereof by about 1.2 mm, due to the existence of the secondary coil in addition to the cross-section of 10 mm×20 mm of the first container 5. The members 18*a* and 18*b* forming the second container 18 each have a thickness of 1 mm at a fitting portion and a thickness of 2 mm at portions other than the fitting portion. The members 18*a* and 18*b* were formed so that an annular hollow part formed of the second container 18 surrounded a cross-section of the first container 5 around which the secondary coil 7 was wound, and a cross-section of the hollow part had an entire circumference of 13 mm×23 mm that was larger than that of the first container 5 by 1.5 mm. Thus, an outer-side separated portion is formed between the first container 5 and the second container 18 even though the secondary coil 7 is wound. Further, through holes each having a diameter of 5 mm were formed in an outer peripheral wall of the second container 18 at axisymmetric positions. As illustrated in FIG. 6A to FIG. 7, the through holes were formed by combining the members 18*a* and 18*b* each having an outer periphery wall in which semicircular, namely, U-shaped cutouts as illustrated in FIG. 10 were formed at axisymmetric positions, the cutouts each having a diameter of 5 mm at an open end thereof. One of the through holes each having a diameter of 5 mm was used as the second opening 19, and the member 18*a* and the member 18*b* were aligned and combined to each other so that the second opening 19 was matched to the first opening 6. The other of the through holes was used as the third opening 20. The first lead-out line pair 4 was passed through the second opening 19, and the second lead-out line pair 8 was passed through the third opening 20.

A breakdown voltage of the above-mentioned isolation transformer was evaluated in the insulating liquid similarly to Example 1. As a result, the average of discharge voltages of this example 1 was about 125 kV, which was the same value as that in Example 2, and the breakdown voltage was increased from Example 1. From the foregoing, an effect of the second container 18 was confirmed, and it was confirmed that the isolation transformer was more increased in breakdown voltage.

Example 4

The X-ray generating apparatus 31 of FIG. 8 was manufactured with the use of the isolation transformer of Example 3 that included a transmission type X-ray tube as the X-ray generating tube 32. A high-voltage insulating oil A (trade name; manufactured by JX Nippon Oil & Energy Corporation) was used as the insulating liquid 41. The container 42 was a brass container and had a ground potential. The container 42 had electrical connectors (not shown), by which the drive control portion 35 and the tube voltage control portion 38 disposed outside of the container 42 were respectively connected to the isolation transformer 36 and the high-voltage transformer 39 disposed inside of the container 42.

In the X-ray generating apparatus 31 of this example, the X-ray generating tube 32 had the anode having a ground potential and the cathode to which a voltage of −100 kV was applied upon the driving. Signals each based on a cathode potential were appropriately applied to the filament electrode, the grid electrode, and the lens electrode. The filament electrode was applied with a DC voltage of 10 V, the grid electrode was applied with a cut-off voltage of −10 V for the non-driving state and a pulse voltage of 100 V for the driving state, and the lens electrode was applied with a DC voltage of 1 kV.

A drive durability test was performed with the above-mentioned driving conditions. No discharge occurred even with 20,000 times driving and stable driving was observed. As described above, with the use of the isolation transformer that had been increased in breakdown voltage, an X-ray generating apparatus having high driving reliability was able to be achieved.

According to the present invention, the insulating liquid is successfully filled into the container of the isolation transformer, and hence an amount of gas bubbles remaining in the container is reduced. Consequently, the isolation transformer is small in size and has an increased breakdown voltage, and the X-ray generating apparatus and the radiography system having high reliability are provided with the use of the isolation transformer.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-001371, filed Jan. 7, 2015, which is hereby incorporated by reference herein in its entirety.

What is claimed is:

1. An isolation transformer, comprising:

an annular core having an annular portion surrounding a bore portion pierced by an imaginary axis;

one coil wound around the annular core;

a first container housing the annular core and the one coil, the first container having an annular shape and an insulating property;

a first lead-out line pair that is connected to the one coil and is extracted outside the first container;

another coil wound around the first container; and a second lead-out line pair connected to the other coil, the isolation transformer being disposed in an insulating liquid, the first container having a first opening through which the insulating liquid flows.

2. The isolation transformer according to claim 1, wherein the first opening is located in the first container on an outer peripheral side thereof.

3. The isolation transformer according to claim 1, wherein the one coil and the other coil are symmetrically located around a central axis of the annular core.

4. The isolation transformer according to claim 3, further comprising a partition structure that is located outside of the first container and protrudes in an axial direction of the first container, wherein, in a radial direction of the first container, the one coil is located on one side of the first container and the other coil is located on another side thereof across the partition structure.

5. The isolation transformer according to claim 1, wherein the first lead-out line pair and the second lead-out line pair are symmetrically located around a central axis of the annular core.

6. The isolation transformer according to claim 5, further comprising a partition structure that is located outside of the first container and protrudes in an axial direction of the first container, wherein, in a radial direction of the first container, the first lead-out line pair is located on one side of the first container and the second lead-out line pair is located on another side thereof across the partition structure.

7. The isolation transformer according to claim 1, wherein the first lead-out line pair is extracted from the first opening.

8. The isolation transformer according to claim 1, wherein a region in the first container other than the annular core and the one coil is a clearance, and wherein the first container has an inner-side separated portion separated from at least one of the annular core and the one coil.

9. The isolation transformer according to claim 8, wherein the inner-side separated portion has an annular shape.

10. The isolation transformer according to claim 1, further comprising a second container housing the first container and the other coil, the second container having an annular shape and an insulating property, wherein the second container has formed therein a second opening, and wherein the first lead-out line pair and the second lead-out line pair are extracted outside the second container.

11. The isolation transformer according to claim 10, wherein the first lead-out line pair is extracted from the first opening and the second opening.

12. The isolation transformer according to claim 11, wherein the second container has a third opening, and wherein the second lead-out line pair is extracted from the third opening.

13. The isolation transformer according to claim 10, wherein a region in the second container other than the first container and the other coil is a clearance, and wherein the second container has formed therein an outer-side separated portion separated from at least one of the first container and the other coil.

14. The isolation transformer according to claim 13, wherein the outer-side separated portion has an annular shape.

15. The isolation transformer according to claim 10, wherein the first container and the second container are located so that an inner periphery of the first container and an inner periphery of the second container overlie each other.

16. The isolation transformer according to claim 15, wherein the first container and the second container are located concentrically.

17. An X-ray generating apparatus, comprising:

an X-ray generating tube housed in a container; and a drive device configured to drive the X-ray generating tube, wherein a surplus space in the container is filled with an insulating liquid, and wherein the drive device comprises an isolation transformer in the container, the isolation transformer comprising:

an annular core having an annular portion surrounding a bore portion pierced by an imaginary axis;

one coil wound around the annular core;

a first container housing the annular core and the one coil, the first container having an annular shape and an insulating property;

a first lead-out line pair that is connected to the one coil and is extracted outside the first container;

another coil wound around the first container; and a second lead-out line pair connected to the other coil, the isolation transformer being disposed in an insulating liquid, the first container having a first opening through which the insulating liquid flows.

18. The X-ray generating apparatus according to claim 17, wherein the one coil of the isolation transformer is closer to a ground potential than the other coil.

19. The X-ray generating apparatus according to claim 17, wherein the one coil of the isolation transformer is electrically connected to an AC power source provided in the drive device.

20. The X-ray generating apparatus according to claim 17, wherein the X-ray generating tube comprises an electron gun, and wherein the other coil is electrically connected to a drive circuit for the electron gun provided in the drive device.

21. A radiography system, comprising:

an X-ray generating apparatus, the X-ray generating apparatus, comprising:

an X-ray generating tube housed in a container; and a drive device configured to drive the X-ray generating tube, wherein a surplus space in the container is filled with an insulating liquid, and wherein the drive device comprises an isolation transformer in the container, the isolation transformer comprising:

an annular core having an annular portion surrounding a bore portion pierced by an imaginary axis;

one coil wound around the annular core;

a first container housing the annular core and the one coil, the first container having an annular shape and an insulating property;

a first lead-out line pair that is connected to the one coil and is extracted outside the first container;

another coil wound around the first container; and a second lead-out line pair connected to the other coil, the isolation transformer being disposed in an insulating liquid, the first container having a first opening through which the insulating liquid flows;

an X-ray detecting apparatus configured to detect an X-ray emitted from the X-ray generating tube and transmitted through an object; and a control apparatus configured to control the X-ray generating apparatus and the X-ray detecting apparatus in a coordinated manner.

* * * * *